United States Patent [19]

Peggs

[11] 4,111,307

[45] Sep. 5, 1978

[54] DISPLAY SUPPORTING MERCHANDISE SECTION DIVIDER

[75] Inventor: Albert L. Peggs, San Dimas, Calif.

[73] Assignee: The Peggs Company Inc., Azusa, Calif.

[21] Appl. No.: 803,043

[22] Filed: Jun. 3, 1977

[51] Int. Cl.[2] ..... A47F 3/08; A47F 5/02

[52] U.S. Cl. ..... 211/1.5; 211/2; 211/131; 211/163

[58] Field of Search ..... 211/1.5, 2, 95, 131, 211/144, 168, 169, 163, 183, 184, 186; 248/223.2, 224.3

[56] References Cited

U.S. PATENT DOCUMENTS

| | | | |
|---|---|---|---|
| D. 180,177 | 4/1957 | Crisafi | 211/144 X |
| 483,024 | 9/1892 | Stewart | 211/163 UX |
| 991,541 | 5/1911 | Rapoport | 211/1.5 X |
| 1,637,998 | 8/1927 | Egan | 211/1.5 X |
| 1,875,563 | 9/1932 | Cooke et al. | 211/1.5 X |
| 2,941,669 | 6/1960 | Palay et al. | 211/1.5 |
| 3,468,428 | 9/1969 | Reibold | 211/144 |
| 3,679,066 | 7/1972 | Leffeld | 211/163 |
| 3,960,275 | 6/1976 | Haughton et al. | 211/182 |

FOREIGN PATENT DOCUMENTS

| | | | |
|---|---|---|---|
| 599,649 | 6/1960 | Canada | 211/169 |
| 636,384 | 1/1928 | France | 248/224.3 |
| 1,444,184 | 5/1966 | France | 211/1.5 |
| 359,146 | 9/1922 | Fed. Rep. of Germany | 211/163 |

*Primary Examiner*—Thomas J. Holko
*Attorney, Agent, or Firm*—Wm. Jacquet Gribble

[57] ABSTRACT

A divider for separating sections of merchandise display rows has a divider frame which may include a divider panel on the frame and a pair of static mounts also on the frame. A plurality of interchangeable display units each with a pair of attachment means are adapted to fit releasably either to static mounts on the frame or pivot mounts on the frame such that various display units may be attached and detached from the merchandise section divider in static or rotatable position.

8 Claims, 11 Drawing Figures

Fig. 7.
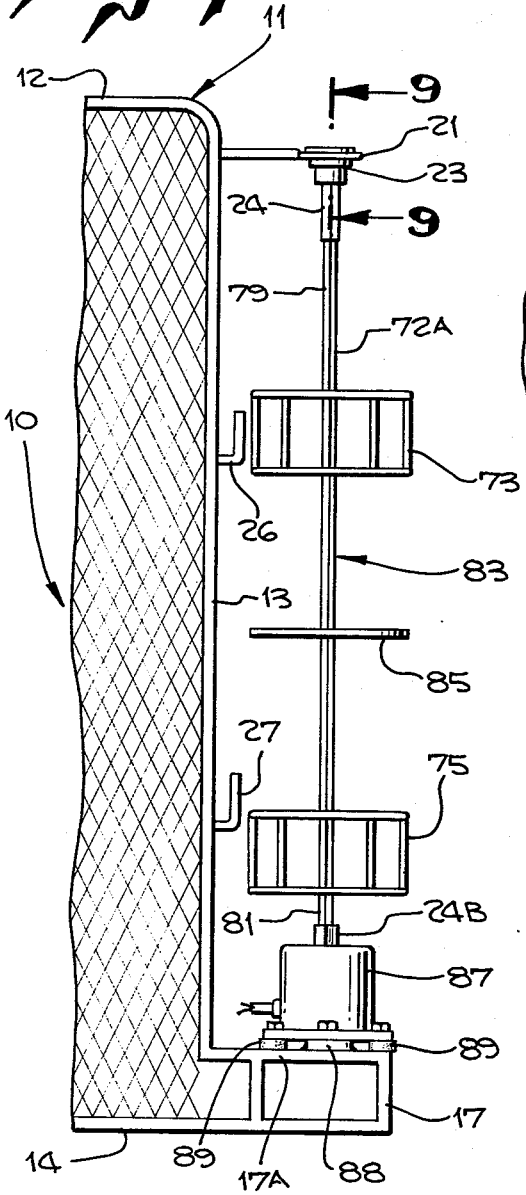
Fig. 8.
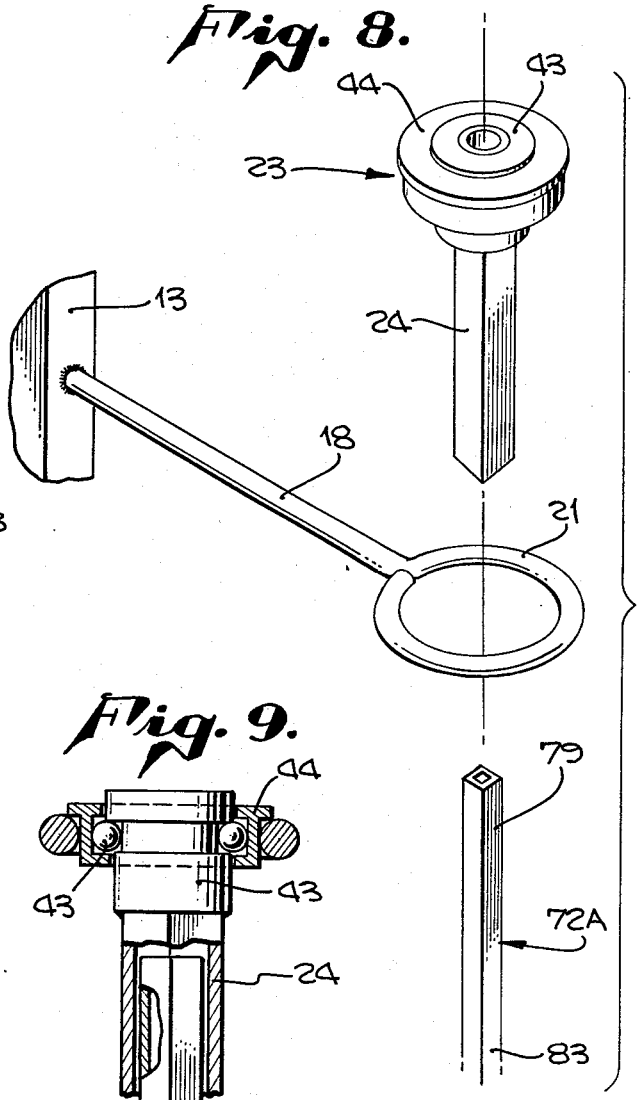
Fig. 9.
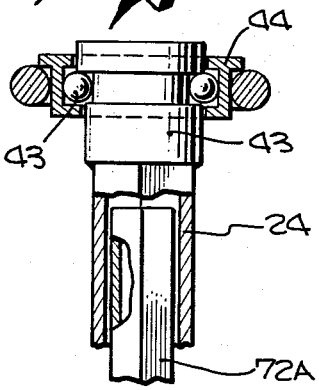
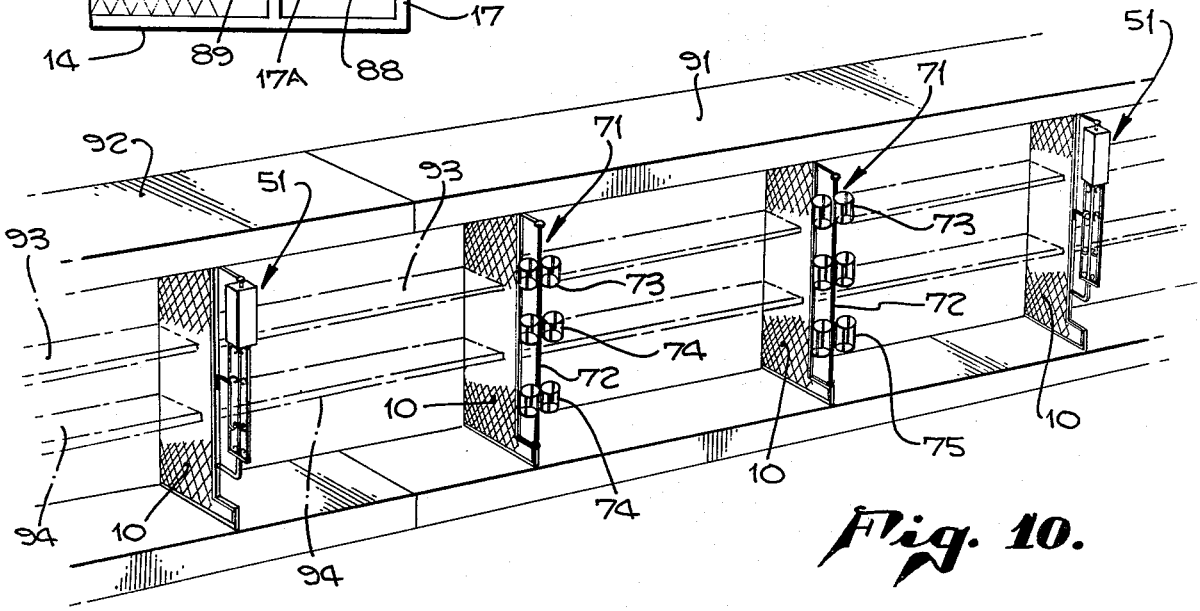
Fig. 10.

DISPLAY SUPPORTING MERCHANDISE SECTION DIVIDER

BACKGROUND OF THE INVENTION

In many self-service and other merchandising stores it has become conventional to use vertical merchandising section dividers to separate merchandise of various categories into areas on continuous shelves. Sectionizing is both for convenience of the merchandiser in restocking and for the convenience of buyers in locating certain types of merchandise they wish to purchase. Most of such merchandising stores are of the self-service variety where the customer selects the merchandise from the shelf. Many such stores employ various attractive signs and displays to call attention to the wares and to induce more "impulse" buying.

It is advantageous to change such displays from time to time, sometimes because the merchandising section is relocated within the store premises and other times for seasonal adjustments in merchandise. Many displays have been haphazardly attached to the storage bins, shelving or the merchandise. Other indicators of the type of merchandise within a section are hung from ceilings over the particular sections or displays are placed on floor stands which are subject to displacement or removal by customers.

I have invented a merchandise section divider which is capable of supporting one or more display units and which is additionally capable of supporting displays of different natures. By providing attachment units on the frame of the merchandise section divider means is provided for not only separating the display shelving into merchandise sections but also for selectively placing display identity, advertising or merchandise samples on display at the section divider. By providing both static mounts and pivot mounts on the divider frame the necessity for ceiling hangers or floor stands is eliminated along with the problems attendant thereto.

SUMMARY OF THE INVENTION

The invention contemplates a merchandise section divider for supporting one of a plurality of display units and comprises a divider frame, which may have a divider panel on the frame, and one of a plurality of display units. A pair of static mounts on the frame releaseably attaches one of said display units on the frame. A pair of pivot mounts on the frame alternatively releaseably attaches another display unit which has attachment means adapted to join to a pair of said pivot mounts.

The static mounts may comprise vertically spaced parallel brackets adapted for joinder with downwardly opening attachment means of like vertical spacing on a display unit.

The section divider may further comprise a display unit with an indicia-receiving plate which may have lighting means thereon.

Preferably a merchandise section divider has both static and pivot mounts, such that either type of display means may be secured to the section divider without the necessity of moving the section divider from its place in the row of merchandise shelving or bins.

As is evident from the foregoing, the display units may be of either static or turning type and may display advertising literature, slogans or other indicia or may display the goods themselves which may be rotated to attract attention to the goods. These and other advantages of the invention are apparent from the following detailed description of the drawing.

BRIEF DESCRIPTION OF THE DRAWING

FIG. 7 is a further alternate embodiment of the invention shown in side elevation and utilizing a powered rotating display unit;

FIG. 8 is a fragmentary perspective elevation of the embodiment of FIG. 7 showing the relationship between the attachment means of the display unit and the divider frame;

FIG. 9 is a fragmentary sectional elevation taken along 9—9 of FIG. 7 partly broken away; and FIG. 10 is a perspective front view of merchandise rows divided by merchandise section dividers and display units in accordance with the invention.

In the various Figures like reference numbers are used to identify like parts.

DESCRIPTION OF THE PREFERRED EMBODIMENTS

Figure 1:
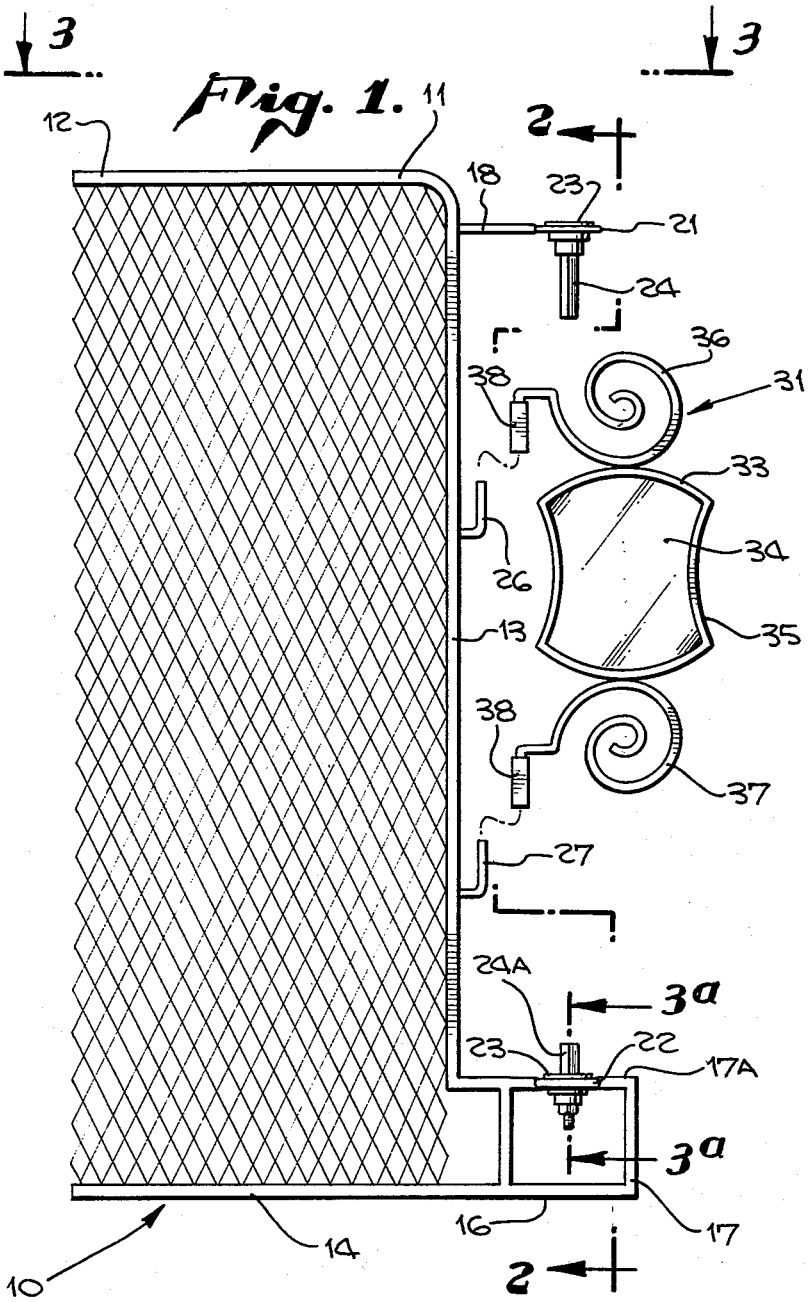
FIG. 1 is a side elevation showing a merchandise section divider and a display unit in separated relationship.
Figure 2:
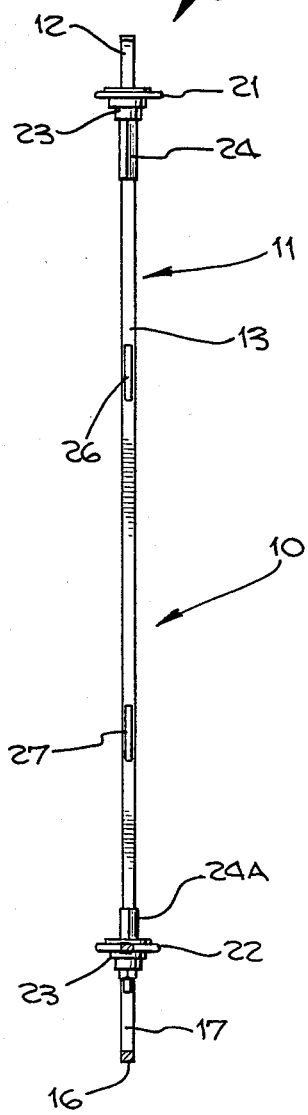
FIG. 2 is an end elevation of the embodiment of FIG. 1 taken along line 2—2 of FIG. 1.
Figure 3A:
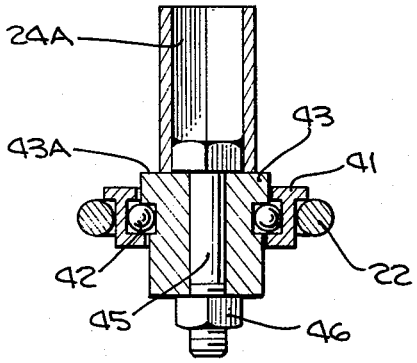
FIG. 3A is a fragmentary sectional elevation taken along line 3A—3A of FIG. 1.
Figure 3:
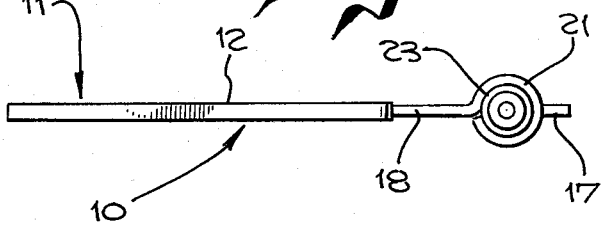
FIG. 3 is a plan view of the section divider of FIG. 1 taken along line 3—3 of FIG. 1.

FIGS. 1 through 3 illustrate a merchandise section divider 10 in accordance with the invention and having a frame 11 comprised of a top runner 12, a vertical runner 13, and a bottom runner 14 to which a divider panel 15 is fixed as by welding to define a separator to be placed between shelving sections of a continuous merchandise display as shown in FIG. 10. Bottom runner 14 extends in a foot section 16 which is part of a square support structure 17 with a top bar 17A extending from runner 13. Also extending from runner 13 is an upper support 18. Both supports 18 and square section 17 have annular loops 21,22 respectively in which reside bearings 23 and extending attachment means 24,24A.

L-shaped static mounts 26 and 27 are fixed to the vertical runner 13 at vertically spaced intervals thereon. While the runners 12,13 and 14 have been shown as square rod or tubing the invention does not preclude the use of cylindrical rod or tubing for the purpose of defining frame 11 and square structure 17.

A display unit 31 is shown removed from frame 11 slightly elevated from its normal attached position thereto. The display unit comprises a display escutcheon 33 which may comprise a translucent or transparent plate 34 to which advertising indicia (not shown) may be fixed. The plate is outlined by an escutcheon frame 35 of any suitable formable material. Ornamental scrolls 36,37 at the top and bottom respectively of the escutcheon terminate leftwardly in FIG. 1 with downwardly opening bracket mates 38 which are adapted to fit like cups over the upwardly extending rods of attachment means 26,27 of the frame.

It is thus evident that display unit 31 may be readily but securely attached to the merchandise section divider 10 by means of the static mounts 26,27 and the bracket mates 38 of the display unit. The configuration of the display unit is illustrative only and many ornamental and artistic display configurations may be utilized to call attention to the divider and to define the termination or beginning of a particular section.

While FIG. 1 illustrates how the static mounts 26,27 of the frame of 11 may be utilized to secure removably a display unit, the Figures also illustrate pivot mounts for alternatively securing revolving display units to the same merchandise section divider. In FIG. 3A the cylindrical loop 22 is seen to receive a bearing cup 41 in which ball bearings 42 reside in friction reducing relationship to a bearing race 43 of conventional construction. However race 43 receives a securing bolt 45 axially and a square tube attachment 24A is fixed to race top 43A to rotate therewith. A bolt 45 is secured to the race by a nut 46 and cup 41 may be tack-welded to the loop 22 as shown in FIG. 3A.

A bearing 23 is similarly secured within loop 21 and its depending attachment bracket 24 opens toward tube 24A and is axially aligned therewith.

Figure 4:
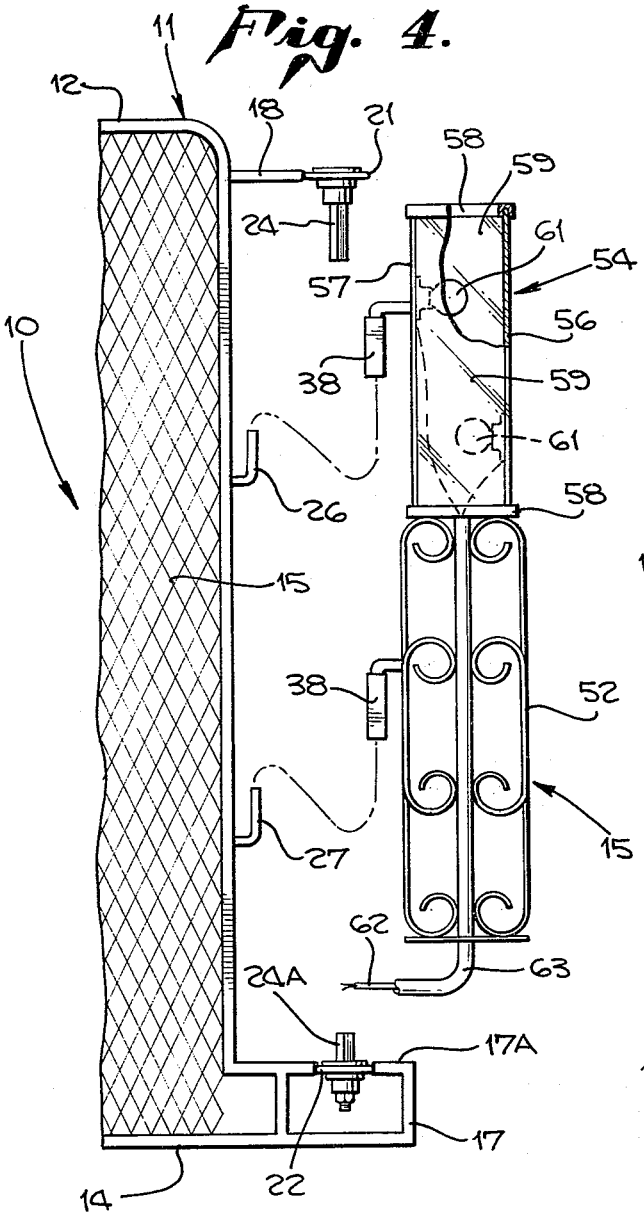
FIG. 4 is a fragmentary side elevation of an alternate embodiment of the invention showing an illuminated display unit.

However, FIG. 4 illustrates merchandise section divider 10 with static mounts 26,27 positioned to receive an alternate display unit 51 which is lighted. The display unit may comprise a lower ornamental scroll section 52 to which downwardly opening bracket mate 38 is attached for fitting to static mount 27. A display panel box 54 is supported above scroll 52 and has affixed thereto a second bracket mate 38 which opens downwardly to fit over static mount 26.

Display box 54 may comprise spaced rigid frame members 56,57 and top and bottom end pieces 28 which combine to secure translucent or transparent side panels 59 in place about illuminating bulbs 61.

The bulbs are powered by means of electrical wiring 62 which extends from any convenient outlet within the shelving being divided and upwardly through L-shaped conduit 63 which extends to the bottom end 58 of the display box. Conduit 63 may form the center axle for mounting the decorative scrolls or scroll panel 52 as well as to conduct the electrical leads from the power source.

It can be seen from FIG. 4 that an electrical display unit may be mounted to the merchandise section divider by means of the static mounts and the downwardly opening bracket mates. It is preferred that the bracket mates be square tubing and the static mounts be square rod such that the coplanar orientation of the display panel with the divider panel 15 may be maintained.

Figure 5:
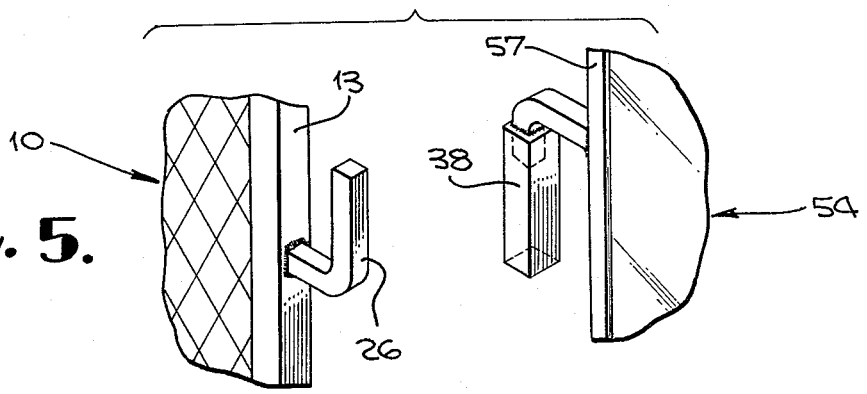
FIG. 5 is a fragmentary perspective elevation showing in separated relationship the related attachment means of a display unit and a divider section frame.

The configuration which is preferable is demonstrated in the exploded view of FIG. 5 which fragmentarily shows the static mount 26, the bracket mate 38, the vertical runner 13 of frame 11 and the frame member 57 of display box 54.

Figure 6:
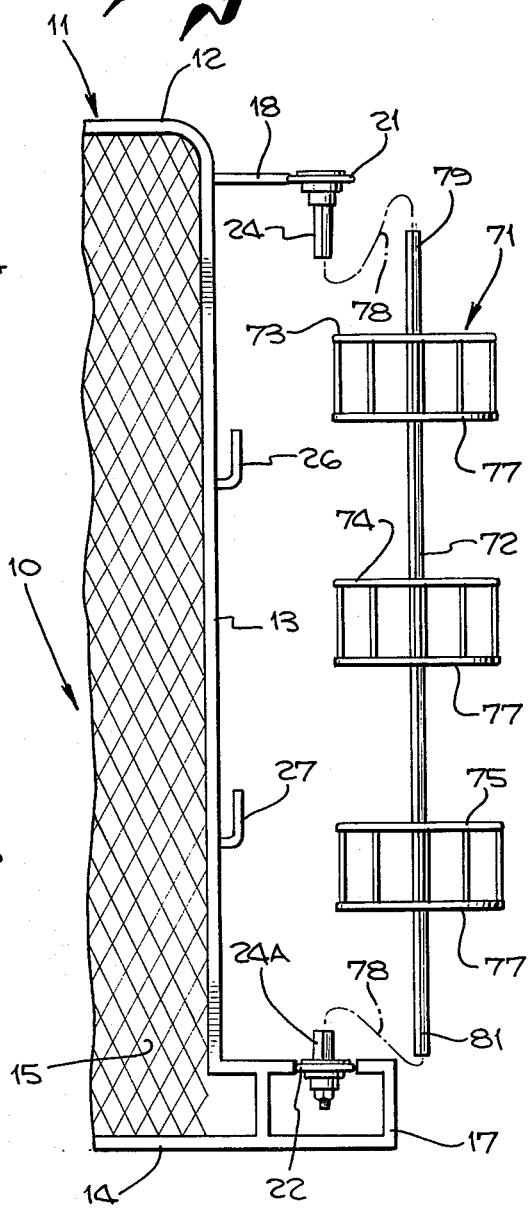
FIG. 6 is a fragmentary side elevation showing an alternate display unit utilizing the pivot mounts of the section frame.

In the embodiment of the invention illustrated in FIG. 6, static mounts 26,27 are not utilized. Instead, the attachment brackets 24,24A extending from the top and bottom bearings of the bearing loops 21,22 are utilized to rotatably secure a display unit 71 to the merchandise section divider 10. Display unit 71 comprises a central axle 72, which is preferably of a square rod, and a plurality of vertically spaced open baskets 73,74,75 adapted to receive sample merchandise to be displayed. The samples (not shown) rest on the floor 77 of each basket. Preferably the floor is an open mesh of conventional design to reduce the weight of the display unit.

As indicated by the connecting lines 78, display unit 71 is assembled with section divider 10 by slipping upper end 79 of the display unit axle into the hollow attachment bracket 24, a sufficient distance for the lower end 81 to be receivable in the hollow attachment bracket 24A of the lower bearing 23. The central axle 72 has a vertical length greater than the span between attachment brackets 24,24A but less than the distance between the bearings 23.

In FIG. 7 an alternate embodiment of the invention is illustrated in which merchandise section divider 10 is employed with its pivot mounts and attachment brackets 24,24B to receive a display unit 83. Unit 83 comprises a central axle 72A with open baskets 73,75 spaced vertically on either side of a horizontal shelf 85 fixed to the axle to rotate therewith. Upper end 79 of the axle fits within attachment bracket 24 and lower end 81 fits within an attachment bracket 24B which extends from the output shaft of an electric motor 87.

Motor 87 seats upon a platform 88 which is centrally supported on square structure bar 17A and pads 89 on upper bar 17A of the square structure 17.

While assembly of the display may be made as shown in FIG. 8 with removal of bearing 23 from loop 21 so that attachment bracket 24 may be lowered over end 79 of the central axle 72, it is preferred that the bearing be permanently fixed within loop 21 and assembly be made as described in conjunction with the description of the embodiment of FIG. 6. The fitting of the central axle 72A and the upper pivot mount is shown in fragmentary section in FIG. 9 with the relationship of attachment bracket 24 to the bearing race 43 being shown. Also shown is central axle 72A broken away to show that it may be also hollow square tubing of a lesser size than the hollow square tubing of which attachment bracket 34 is made.

In FIG. 10 merchandise bins 91,92 each of which is shown fragmentarily, have a plurality of top and bottom horizontal shelves 93,94 respectively, shown in broken lines. Each shelf section is divided from its adjacent section by a merchandise section divider 10. The four section dividers establish a section with three shelf subdivisions. The outer section dividers are shown assembled with static display units 51 of the lighted type as shown in FIG. 4, designating limits of a particular merchandise section such as a gourmet foods section. Inner dividers 10 have rotating display units 71 as shown in FIG. 6.

The exemplary display units may be removed and either static or turning units, or powered units, substituted as desired, the invention lending itself to a variety of attention-directing arrangements.

Several different embodiments of this invention have been shown and described to make the invention known. However, other variations within the scope of the invention will occur to those skilled in this art. It is therefore desired that the invention be measured by the appended claims rather than by the foregoing illustrative examples.

I claim:

1. A merchandise section divider for supporting one of a plurality of display units and comprising a divider frame, a divider panel within the frame, said panel and frame defining a divider of substantially flat, planar configuration, a display unit, a pair of static mounts on the frame extending within the plane defined by the divider for releasably attaching a static display unit to the frame, a pair of pivot mounts on the frame extending within the plane defined by the divider for releasably attaching a pivotal display unit, and attachment means on each display unit adapted to join a pair of said mounts for releasably alternatively attaching a display unit to the divider.

2. A section divider in accordance with claim 1 wherein said pair of static mounts comprises spaced, parallel brackets and said attachment means comprises a pair of bracket mates of like spacing on said static display unit.

3. A section divider in accordance with claim 2 wherein each of said brackets comprises an upright rod and each of said bracket mates comprises a downwardly opening cup.

4. A section divider in accordance with claim 2 wherein said static display unit further comprises an indicia-receiving plate.

5. A section divider in accordance with claim 4 wherein said static display unit further comprises lighting means for said indicia-receiving plate.

6. A section divider in accordance with claim 1 wherein each pivot mount comprises a horizontally extending support fixed to the divider frame, a bearing on said support, and an attachment bracket extending from said bearing.

7. A section divider in accordance with claim 6 wherein said pivotal display unit comprises a central column, an attachment bracket joint at each end of said column, and at least one shelf on said column adapted to receive merchandise to be displayed.

8. A section divider in accordance with claim 1 wherein each pivot mount comprises a horizontally extending support, said supports of said pivot mounts being vertically spaced; a bearing, an attachment bracket extending from each bearing toward the other horizontally extending support, and a power unit adapted to rotate one of said attachment brackets and fixed to one of said supports.

* * * * *